United States Patent [19]

Stryjewski

[11] 4,435,633

[45] Mar. 6, 1984

[54] FLASH FUSING APPARATUS

[75] Inventor: Walter A. Stryjewski, Hilton, N.Y.

[73] Assignee: Eastman Kodak Company, Rochester, N.Y.

[21] Appl. No.: 258,961

[22] Filed: Apr. 29, 1981

[51] Int. Cl.[3] ..... H05B 3/02; H05B 1/00

[52] U.S. Cl. ..... 219/216; 219/388; 219/469; 432/230

[58] Field of Search ..... 219/216, 388, 469, 470, 219/471; 355/3 FU; 432/8, 59, 230

[56] References Cited

U.S. PATENT DOCUMENTS

| | | | |
|---|---|---|---|
| 3,202,818 | 8/1965 | Thomiszer | 219/216 X |
| 3,249,738 | 5/1966 | Simm et al. | 219/216 |
| 3,280,717 | 10/1966 | Bungay | 219/216 X |
| 3,301,157 | 1/1967 | Smith et al. | 219/216 X |
| 3,449,546 | 6/1969 | Dhoble | 219/216 |
| 3,452,181 | 6/1969 | Stryjewski | 219/216 |
| 3,637,976 | 1/1972 | Ohta et al. | 219/216 |
| 3,935,424 | 1/1976 | Donnelly et al. | 219/216 |
| 3,944,783 | 3/1976 | Donnelly et al. | 219/216 |
| 4,132,882 | 1/1979 | Endo et al. | 219/216 |
| 4,205,220 | 5/1980 | O'Brien | 219/216 |

*Primary Examiner*—Volodymyr Y. Mayewsky
*Attorney, Agent, or Firm*—Lawrence P. Kessler

[57] ABSTRACT

An improved apparatus and method for fusing images of pigmented thermoplastic resin marking particles to a receiver member. A marking particle image on the surface of a receiver member contacts the peripheral surface of a hollow member. A source of radiant energy, capable of at least partially melting such particles, is mounted within the hollow member. The hollow member is transparent to the energy of the source. The entire image-bearing surface of the receiver member is simultaneously pressed into full and intimate contact with the peripheral surface of the hollow member in order to lower the particle/receiver member boundary thermal resistance and enhance particle flow during radiation of energy by the source to fuse the image to the receiver member.

8 Claims, 3 Drawing Figures

FLASH FUSING APPARATUS

BACKGROUND OF THE INVENTION

This invention relates generally to fusing marking particle images to a receiver member for example in an electrostatographic process, and more particularly to radiant energy fusing in which the entire surface of the receiver member bearing the image is pressed into intimate confact with a radiant energy transparent member located between the receiver member and the radiant energy source.

In a typical electostatographic process, a latent electrostatic charge image on an intermediate member is developed by contacting the charge image with a colorant (toner) in the form of dry resinous marking particles. The particles are electrostatically charged in an opposite sense to the latent charge image and adhere to the intermediate member to form a visible imagewise distribution of marking particles corrresponding to the latent charge image. The visible imagewise distribution of particles is then transferred to the surface of a receiver member. Subsequently, the transferred particles are fixed (fused) to the receiver member. The fusing operation is accomplished by application of energy (such as heat and/or pressure) or solvent vapor to the particles and the receiver member. The energy, or solvent vapor, at least partially melts the particles so that the melted portions adhere to each other and to the surface of the receiver member. For example, when the receiver member is a sheet of bond paper, the melted portion imbibes into the surface fibers of the paper. Thus when the melted particles cool and re-solidify, they are firmly attached to the paper.

One method of fusing marking particles to a receiver member involves directing radiant energy onto the particles and member. With radiant energy fusing, the energy for melting the particles is substantially instantly available and does not require an intervening medium such as a heat sink for its propagation. As such, no long warm-up periods for the intervening medium are required, nor does the energy have to be transferred through a relatively slow acting heat sink. However, to effectively use radiant energy fusing, uniform irradiance over a large surface area of the receiver sheet must be produced to uniformly irradiate the marking particle image. Further, when using a flash lamp for example as the radiant energy source, a reflector of appropriate geometry may be required so that a substantial portion of available radiant energy emitted by the lamp during the relatively short flash period of the lamp is utilized.

U.S. Pat. No. 3,944,783 (issued Mar. 16, 1976 in the name of Donnelly et al) and U.S. Pat. No. 4,205,220 (issued May 27, 1980 in the name of O'Brien) show radiant energy fusing apparatus utilizing an elongated flash lamp for producing a pulse of radiant energy. The marking particle bearing receiver member forms a portion of a cylinder having an axis coincident with the axis of the elongated flash lamp. The geometric configuration of such apparatus provide uniform irradiance of the receiver member, with a substantial portion of the available emitted radiant energy, by utilizing the receiver member as a reflector for the energy. However, in the apparatus of these patents, the marking particles are held in contact with the receiver member predominantly by residual electrostatic forces. As a result fusing of the particles to the receiver member may be incomplete due to high particle/receiver member thermal resistance, lack of flow of the particles in the melted state, or slow cooling after the energy source is quenched.

SUMMARY OF INVENTION

This invention is directed to an improved apparatus and method for using images of pigmented thermoplastic resin marking particles to a receiver member. A marking particle image on the surface of a receiver member contacts the peripheral surface of a hollow member. A source of radiant energy, capable of at least partially melting such particles, is mounted within the hollow member. The hollow member is transparent to the energy of the source. The entire image-bearing surface of the receiver member is simultaneously pressed into full and intimate contact with the peripheral surface of the hollow member in order to lower the particle/receiver member boundary thermal resistance and enhance particle flow during radiation of energy by the source to fuse the image to the receiver member.

The invention, and its objects and advantages, will become more apparent in the detailed description of the preferred embodiment presented below.

BRIEF DESCRIPTION OF THE DRAWINGS

In the detailed description of the preferred embodiment of the invention reference is made to the accompanying drawing, in which.

DESCRIPTION OF THE PREFERRED EMBODIMENT

Figure 1:
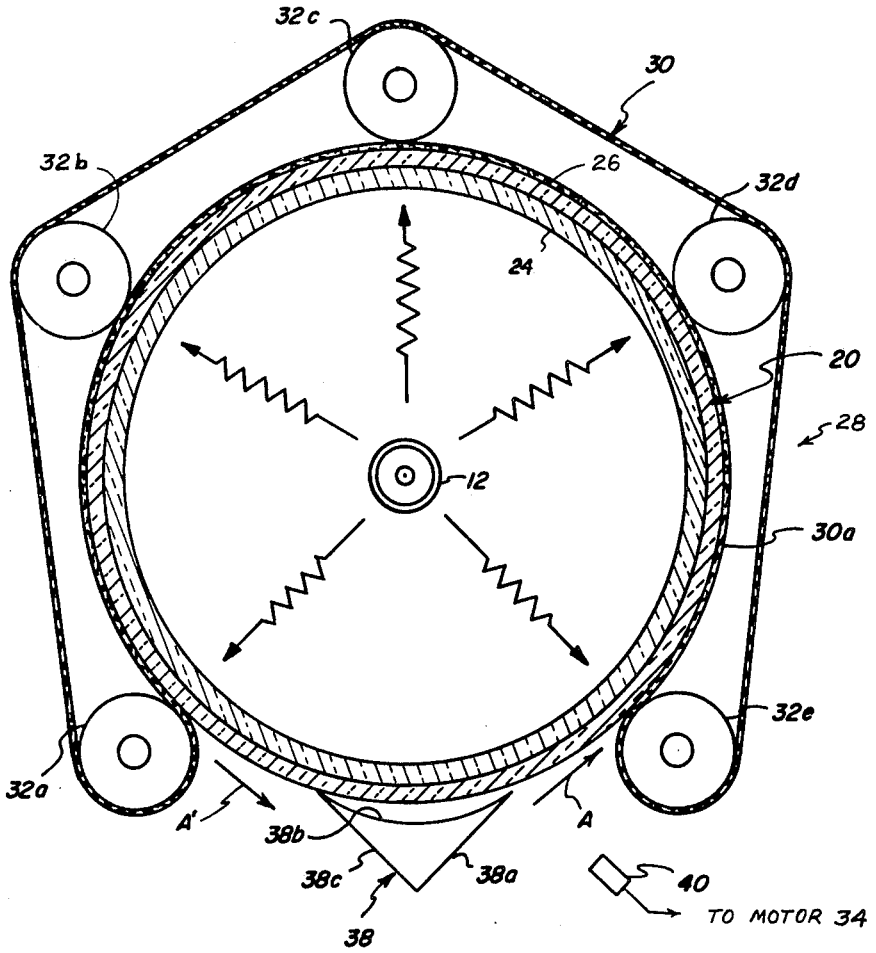
FIG. 1 is a side elevational view of the radiant energy fusing apparatus according to this invention.
Figure 2:
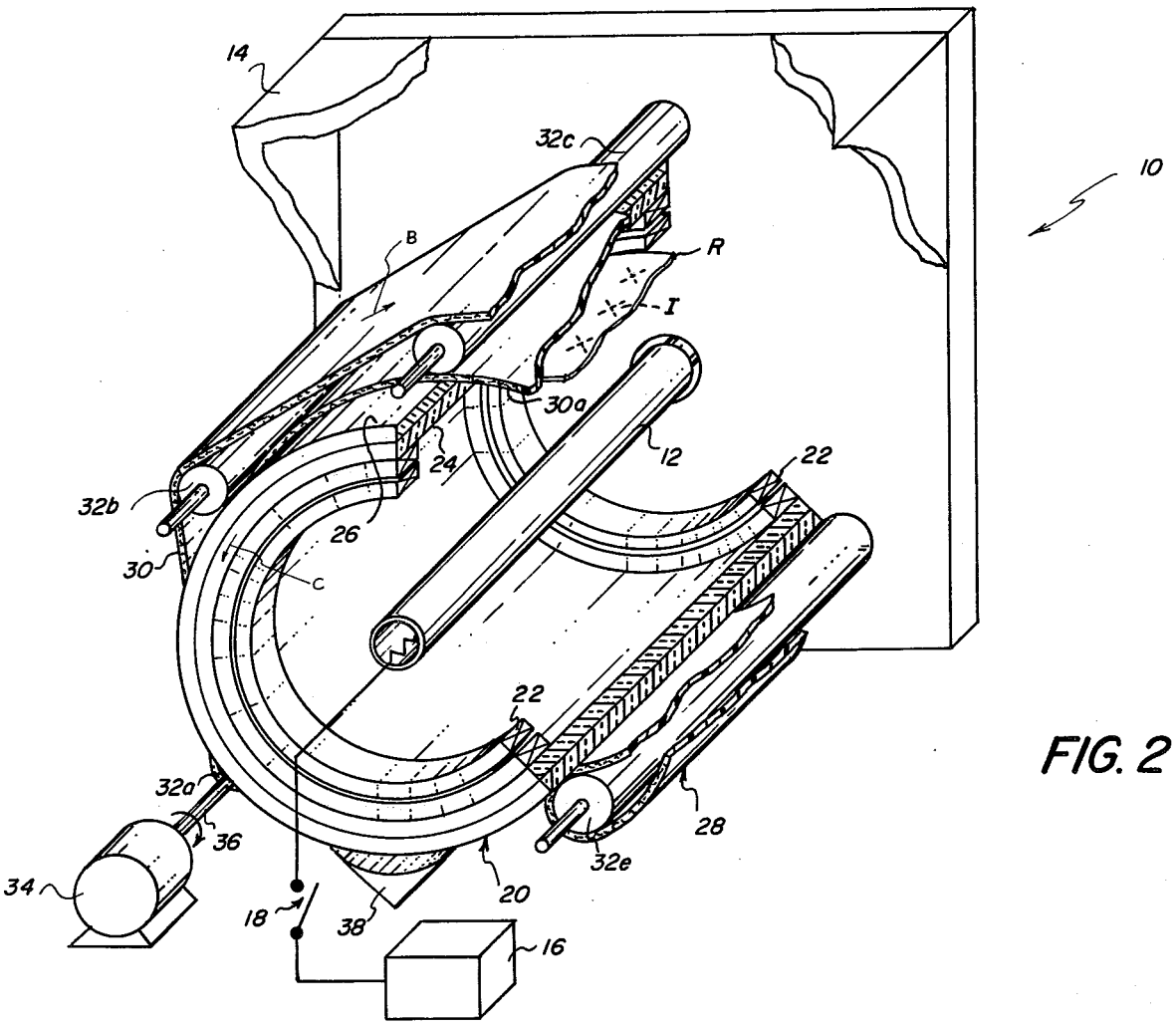
FIG. 2 is an isometric view of the apparatus of FIG. 1, portions being removed or broken away to facilitate viewing.

Referring now to the drawings FIGS. 1 and 2 show a radiant energy fusing apparatus, generally designated by the numeral 10. The apparatus 10 is particularly adapted to fuse marking particle images to receiver members (e.g. image I to member R of FIG. 2) produced by a typical electrostatographic process such as shown in the above mentioned U.S. Pat. Nos. 3,944,783 or 4,205,220. The marking particles which make up the images are, for example, pigmented thermoplastic resin such as described in U.S. Pat. No. 3,903,935 issued July 8, 1975, in the name of Jadwin et al; while the receiver members are, for example sheets of bond paper or transparency material. Accordingly, when particles on a receiver member are subjected to radiant energy they absorb such energy as heat. When sufficient energy is absorbed, the heat at least partially melts the particles so that the melted portions adhere to each other and the surface of the member. When the melted particles cool and re-solidify, they are firmly attached to the member.

The apparatus 10 comprises an elongated flash lamp 12, such as a xenon flash tube, mounted in a frame 14 (see FIG. 2). The lamp 12 is coupled to a power supply 16 through a switch 18 to produce a pulse of radiant energy each time the switch is closed. A cylindrical roller 20 is rotatably supported in the frame 14 by bearings 22 such that the rotational axis of the roller is coincident with the longitudinal axis of the lamp 12. The roller 20 includes a glass cylinder 24 covered by a sleeve 26 (or coating) of marking particle offset preventing material such as polytetrafluoroethylene, or liquid such as silicone oil. The glass cylinder 24 and the sleeve 26 are selected to be transparent to the radiant energy of the lamp 12.

A compliant drive member 28 surrounds a substantial portion of the circumference of the roller 20. The drive member 28 includes a dimensionally stable, flexible belt 30 of silicone rubber for example. The outer surface of the belt reflects the radiant energy of the lamp 12. The belt 30 is mounted on a series of rollers 32*a*–32*e* supported by the frame 14 such that a run 30*a* of the belt is in intimate contact with the roller 20. Roller 32*a* is coupled to a motor 34 through a drive shaft 36. The motor 34 drives the roller 32*a* in a clockwise direction (when the apparatus is viewed in FIG. 1) to move the belt 30 about its closed loop path in the direction of arrow B (FIG. 2). The belt, in turn, frictionally drives the roller 20 in the direction of arrow C (FIG. 2).

A deflector 38, of longitudinal dimension substantially equal to that of the roller 20, is supported by the frame 14 in fixed relation to the roller. The deflector has a surface 38*a* which serves to direct the receiver member, traveling in the direction of arrow A of FIG. 1, into contact with the roller 20 between the roller and the run 30*a* of belt 30. The surface 38*b* of the deflector reflects the radiant energy of the lamp 12 and prevents escape of a substantial portion of the energy passing through the roller 20 between the belt supporting rollers 32*a* and 32*e*. Additionally the deflector 38 has a surface 38*c* with its leading edge in light pressure contact with the roller 20. The surface 38*c* serves to strip a receiver member from the roller 20 after fusing and direct the member to travel in the direction of arrow A′ of FIG. 1.

In the operation of the radiant energy fusing apparatus 10, a receiver member bearing a marking particle image on its surface facing the roller 20 is transported by a mechanism (not shown) in the direction of arrow A of FIG. 1. When the lead edge of the receiver member is detected, such as by sensor 40, the motor 34 is actuated to drive the belt 30 and rotate the roller 20. The receiver member enters between the run 30*a* of the belt 30 and the roller 20 and is transported with the roller as it is rotated by the belt. At a predetermined time selected to insure that the entire receiver member lies between the roller 20 and the belt run 30*a*, the switch 18 is closed to fire the flash lamp 12 and produce a pulse of radiant energy. As an illustrative example, to provide a pulse of radiant energy sufficient to adequately fuse a thermoplastic resin particle image to a bond paper receiver member, the power supply 16 for the xenon flash tube lamp 12 has an output in the range of 300 to 2400 joules. The switch 18 is closed for a time duration to establish a flash pulse width in the range of 0.125 to 2000 miliseconds. During the period of the flash pulse, the entire receiver member is being pressed by the belt 50 into intimate contact with the peripheral surface of the offset preventing sleeve 26 of the rotating roller 20 to form a cylindrical reflector for the radiant energy. Additionally, the reflective surfaces of the belt 30 and the deflector 38 reflect the radiant energy to keep a substantial portion of the energy within the envelope of the roller 20. Thus nearly all of the developed radiant energy is available to uniformly strike the entire image-bearing area of the receiver member to effect the fusing of the marking particle image carried by such member.

Figure 3:
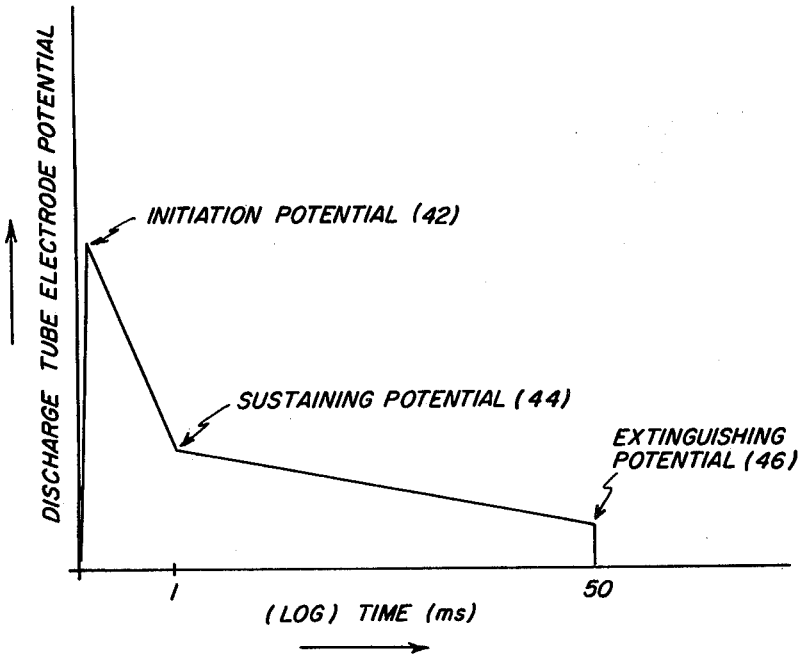
FIG. 3 is a graphical representation of the output of the flash lamp of the apparatus of FIG. 1, where the discharge potential of the lamp is plotted against time (on a log scale).

A preferred output profile for the lamp 12 is shown in the graph of FIG. 3. The discharge potential of the lamp, which is directly related to the radiant energy developed, has a high output, sharp, short leading edge initiation potential 42, with a sustained lower potential discharge 44, down to fthe extinguishing potential 46 after approximately 50 miliseconds. The high output leading edge potential developes radiant energy which raises the temperature of the marking particles rapidly to a flowing state, and the lower sustaining discharge continues to add energy to the particles while in such flowing state. The intimate contact of the marking particles and the receiver member, induced by the cooperation of the belt 30 and roller 20, reduces the particle/-receiver member boundry thermal resistance and enhances flow for promoting adherance of the particles to each other and to the member. Moreover, after the extinguishing potential is reached, the roller 20 acts as a heat sink to promote rapid cooling of the melted particles for improved fusing of the particles to the receiver member. Accordingly, no further conditioning of the receiver member is required after fusing.

As the fusing is completed, the continued rotation of the roller 20 by the compliant drive member 28 causes the receiver member to exit from between the roller 20 and the belt run 30*a* to travel in the direction of arrow A′ (FIG. 1) to an output station, for example. As noted above the surface 38*c* of the deflector 38 assures that the receiver member is stripped from the roller and thus prevents the member from following the roller. It should also be noted that with the preferred output profile for the lamp 12, the roller 20 has a diameter of approximately 4″ and is driven at an angular velocity of 75 revolutions per minute. Such arrangement assures that the apparatus 10 fuses the entire marking particle image on a typical receiver member up to 8½″ (measured in the direction of movement of the receiver member) without having to stop rotation of the roller 20. However, if necessary, with different lamp output profiles, roller diameters, or roller angular velocities, the drive for the roller 20 could be interrupted during one radiant energy pulse so that the receiver member remains completely within the effective area of the radiant energy to insure fusing of the entire image to such member.

The invention has been described in detail with particular reference to a preferred embodiment thereof, but it will be understood that variations and modifications can be effected within the spirit and scope of the invention.

I claim:

1. In apparatus for fusing images formed of pigmented thermoplastic resin marking particles to a receiver member, such apparatus including a hollow member for contacting on its peripheral surface a marking particle image on the surface of such receiver member and a source of radiant energy, capable of at least partially melting such particles, mounted within said hollow member, said hollow member being substantially transparent to the energy of said source, the improvement comprising:

means, effective during radiation of energy by said source, for simultaneously pressing the entire image-bearing surface of a receiver member into full and intimate contact with said peripheral surface of said hollow member to lower the particle/receiver member boundary thermal resistance and enhance particle flow during fusing of the image to said receiver member.

2. The invention of claim 1 wherein said hollow member is cylindrical and said radiant energy source is an elongate lamp mounted coincident with the longitudinal axis of said hollow member.

3. The invention of claim 1 wherein said hollow member includes an offset preventing material forming said peripheral surface.

4. The invention of claim 1 wherein said pressing means comprises a dimensionally stable flexible belt supported for engagement with more than half of said peripheral surface of said hollow member.

5. Apparatus for fusing a pigmented thermoplastic resin marking particle image to a receiver member, said apparatus comprising:

an elongate flash lamp producing radiant energy;

a cylindrical member transparent to radiant energy produced by said flash lamp, said cylindrical member being mounted for rotation about an axis coincident with the longitudinal axis of said flash lamp;

offset preventing means on the peripheral surface of said cylindrical member, transparent to radiant energy produced by said flash lamp, for preventing adherence of a marking particle image to said cylindrical member;

a plurality of rotatable rollers mounted in spaced relation about the peripheral surface of said cylindrical member, the axes of such rollers being parallel to the rotational axis of said cylindrical member;

a dimensionally stable flexible closed loop belt supported by said rollers in driving contact with a substantial portion of the peripheral surface of said cylindrical member and adapted to transport a marking particle image-bearing receiver member, between said belt and said cylindrical member, and to press the surface of such receiver member bearing the image into intimate contact with said cylindrical member;

means for directing a receiver member between said belt and said cylindrical member; and means, responsive to presence of a receiver member entering between said belt and said cylindrical member, for rotating said cylindrical member whereby such receiver member on said cylindrical member is transported to a position surrounding said flash lamp, at least in part, with the entire image-bearing surface in full and intimate contact with said cylindrical member, where radiant energy produced by such flash lamp fuses the marking particle image to said receiver member.

6. The invention of claim 5 wherein said belt is reflective of radiant energy produced by said flash lamp.

7. The invention of claim 5 wherein said directing means includes means for stripping a receiver member from said cylindrical member subsequent to fusing.

8. The invention of claim 7 wherein said directing means is reflective of radiant energy produced by said flash lamp.

* * * * *